United States Patent [19]

Stevens

[11] Patent Number: 4,529,195

[45] Date of Patent: Jul. 16, 1985

[54] SYNCHRONIZED JUMP ROPE DEVICE

[76] Inventor: Harry Stevens, P.O. Box 5435, Philadelphia, Pa. 19143

[21] Appl. No.: 420,378

[22] Filed: Sep. 20, 1982

[51] Int. Cl.[3] ..... A63B 5/20

[52] U.S. Cl. ..... 272/75

[58] Field of Search ..... 272/74, 75, 1 B, 100, 272/101, 102, 103, 78; 46/129; D21/191; 200/61.93; 273/1.5 R, 1.5 A

[56] References Cited

U.S. PATENT DOCUMENTS

| | | | |
|---|---|---|---|
| 1,893,173 | 1/1933 | Kreutzer | 272/74 |
| 3,064,971 | 11/1962 | Feinn | 272/75 |
| 3,107,092 | 10/1963 | Morris et al. | 272/75 |
| 3,233,892 | 2/1966 | Webber | 272/53.1 |
| 3,411,775 | 11/1968 | Delk, Jr. | 272/75 |
| 3,595,571 | 7/1971 | Spinnett et al. | 272/75 |
| 3,612,522 | 10/1971 | Ekonen | 272/75 |
| 3,917,263 | 11/1975 | Wiley | 273/1.5 A |
| 4,082,266 | 4/1978 | Elkins | 272/75 |
| 4,192,501 | 3/1980 | Peoples | 272/75 |
| 4,206,452 | 6/1980 | Blasucci | 200/61.93 X |

FOREIGN PATENT DOCUMENTS

| | | | |
|---|---|---|---|
| 2745145 | 6/1978 | Fed. Rep. of Germany | 272/74 |

*Primary Examiner*—Robert E. Bagwill
*Assistant Examiner*—Arnold W. Kramer
*Attorney, Agent, or Firm*—Steele, Gould & Fried

[57] ABSTRACT

An exercising device for swinging a pair of synchronized jump ropes, comprises a first and second station, each having two rotatable shafts and a lever arm on each shaft extending radially from the shaft, each lever arm having radially spaced holes for attaching a jump rope. The first station is driven by a motor and the second station is freewheeling, being driven only by the first station, through the ropes, with both the driving and freewheeling stations being geared to internally synchronize the two ropes. The motor is electric and as a safety device a spring loaded movable element on a shaft at the driving station axially moves against the spring loading if a jumper interrupts the turning of the rope associated therewith, to interrupt the turning power, where the movable element in one version throws a cutoff switch to the motor and in another version is one plate of a two plate clutch. The clutch slips on interruption and resumes synchronous engagement thereafter.

13 Claims, 8 Drawing Figures

SYNCHRONIZED JUMP ROPE DEVICE

BACKGROUND OF THE INVENTION

1. Field of the Invention

This invention relates to the field of exercise devices, and in particular devices adapted for swinging a pair of synchronized jump ropes, commonly called "Double Dutch".

2. Description of the Prior Art

Various devices have been conceived for swinging jump ropes. Such rope-swinging apparatus are intended to simulate the manual motion of a pair of persons facing one another and swinging a rope together in a circular arc, the rope defining a substantially cylindrical area between the persons, wider at the midpoint and narrower at the ends of the ropes. At the narrowest, the radius of the cylindrical area is defined by the swinger's arm. In use, the rope swingers begin before the jumper begins. Upon the swingers' reaching full speed, a jumper moves into the cylindrical area and, in synchronization with the swinging rope or ropes, jumps over each rope as it repeatedly goes around.

Various mechanical devices have been conceived to simulate the manual motion of the pair of persons swinging a jump rope in a circular arc. Although the required motion is quite simple for persons, the necessary motion is somewhat more difficult to accomplish using a machine. The prior art includes a number of devices employing a driven, rotatable shaft upon which a rope holding means is mounted so as to extend radially from the shaft. A first end of the jump rope is attached to the rope holding member at a point displaced from the shaft, the point defining the circular arc of the swung rope at the driven end. The opposite end of the jump rope is normally tied to a fixed point, the rope being driven only by the shaft at the first end of the rope.

The cylindrical space defined by the swung jump rope must be large enough to encompass the height of the jumper. Due to the centrifugal force of swinging the rope, the rope describes a path bowed outwards from a perfect cylinder. The rope is forced radially outward from the axis of revolution, assuming a curved shape, and accommodating the tallest jumper toward the center of the rope. When the rope is tied to a fixed point at one end, swinging the other end describes a similar area, but the dimensions of the entire encompassed area are reduced. In order to accommodate jumpers of the same height with a jump rope tied to a fixed point at one end, the rope must be longer or the ends must be located closer together than with a rope rotated through an arc at both ends.

The primary problem associated with mechanically rotating a jump rope at both ends thereof relates to the synchronization of rotation at the two, opposite stations. Manually, it is not difficult for users to move in unison to swing a pair of ropes at a given frequency and phase angle. In order to repeat such motion by machine, the prior art has employed two separate methods. These two methods include mechanically gearing the first and second stations to the same motor, whereby both the opposite stations synchronously drive the ropes and the phase angle is set by the gear teeth. A scale model of such a device is disclosed in U.S. Pat. No. 1,893,173—Kreutzer. Alternatively, separate asynchronous drive means may be included for both stations, and the drive means put in such close control of the jumper that the jumper controls the speed and phase angle of the two independently-driven ends. In other words, the user is required to synchronize the power sources. This type of device appears in U.S. Pat. No. 3,107,092—Morris et al.

A rope swinging apparatus employing a common drive shaft or related gearing to synchronize the first and second stations is unduly expensive and complex for the usual playground application. A suitable rope swinging apparatus must be inexpensive enough to come within the usual cost for toys. Even where a playground or school elects to install a mechanical rope swinging apparatus, or if a unit is designed for a health spa or exercise salon, the common gearing or common drive shaft approach is too expensive and complex. The many mechanical parts required to mount the pair of driving stations at a fixed distance from one another, and the various bushings and shaft supports required, result in an enormously heavy and expensive device. Although this approach has been taken in a very small or scale model device (see U.S. Pat. No. 1,893,173—Kreutzer), the device is not practical if attempted in a full scale application.

Requirements such as shaft mountings and the like in a device having common gearing and drive result in further complexity when an attempt is made to design a device which will be at all versatile. For example, attempting a commonly-geared device wherein the rope swinging axis is adjustable to a plurality of heights (i.e., for a range of jumpers) requires that some apparatus be provided to commonly raise and lower both driving sides together. Such complexity is beyond the scope and resources of the usual user for such recreational equipment.

The present invention solves the difficulties of complexity by employing a driving station and a slave station, the slave station being freewheeling and driven only by the motion of the driving station, the driving force being transmitted through the jump rope. Accordingly, there is no requirement of mechanically synchronizing the speed and locking the phase angle of the two rope ends. The freewheeling driven station describes a more-natural rope motion than does a fixed end and a larger jumping area is provided. In a device adapted for swinging a pair of synchronized ropes, the dual shafts included in each station are synchronized with one another, however due to the freewheeling driven station, the driving and driven sides need not be mechanically attached to one another, other than through the jump ropes.

In addition to the more natural action and the fewer parts, the present device is also more compact than former devices, because instead of a fixed end, the narrowest radial span of the jump area is set by the rotating lever arms. Since complexity is minimal, additional features can be easily incorporated such as a height adjustment capability and interlocks to disconnect power in the event a jumper falls or becomes entangled in the ropes.

SUMMARY OF THE INVENTION

It is an object of the invention to provide a rope jumping apparatus which most nearly approximates the motion of persons manually swinging a jump rope to be jumped by a third person.

It is also an object of the invention to minimize the cost and complexity required in a mechanical rope swinging apparatus.

It is another object of the invention to provide a rope swinging device which is safe, durable and effective.

It is yet another object of the invention to produce a rope swinging device that will operate in a minimum space.

These and other objects are accomplished by an exercise device for swinging a jump rope, comprising a first and a second station, each station having a rotatable shaft and a lever arm attached to the shaft and the lever arm extending radially from the shaft, the lever arm having means for attaching the rope to at least one point thereon displaced from the shaft, the first station having means for driving the shaft, the second station having a freewheeling shaft, whereby in operation the first and second stations become synchronized by action of the first station through the jump rope.

The exercise device preferably employs a pair of rotatable shafts in each station, each station havng means for locking the phase angle between the shafts therein, whereby the ropes may be swung alternately, in the matter commonly known as "Double Dutch".

The device may be equipped with a coin-freed timer, a revolution counter, means for disconnecting power upon detection of fouling of the ropes, means for assisting the freewheeling driven station in reaching synchronization with the opposite, master station, and means for adjusting the height of the driving and driven stations. The rope swinging apparatus is preferably mobile, comprising wheels for moving the stations about, and means for locking the wheels at the desired rope swinging location.

BRIEF DESCRIPTION OF THE DRAWINGS

There are shown in the drawings the embodiments which are presently preferred. It should be understood, however, that the invention is not limited to the precise arrangements and instrumentalities depicted.

DESCRIPTION OF THE PREFERRED EMBODIMENTS

Figure 1:
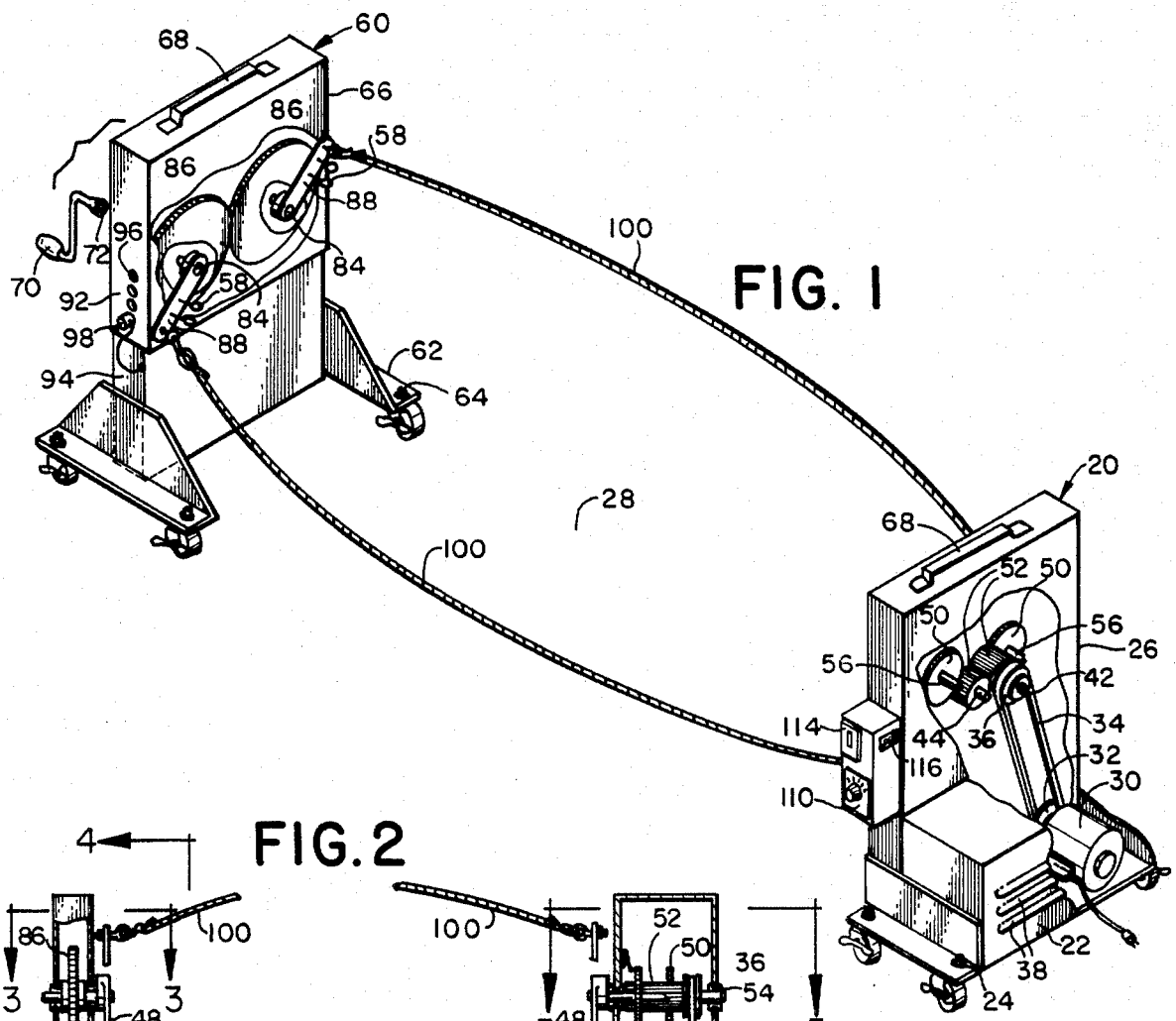
FIG. 1 is a perspective view of the device of the invention, the cabinets enclosing the respective stations being shown partially broken away.

The apparatus of the invention is shown generally in FIG. 1. Driving station 20 is attached to idler station 60 via jump ropes 100, 100. The ropes are to be swung in circular arcs at each station so as to alternately pass around a jumping area 28, between the stations 20, 60. The jumper, taking care to avoid the swinging ropes, darts into the jumping area from the side, and becoming synchronized with the ropes, jumps over the ropes as they alternately come around.

The swinging motion is powered by motor 30 in driving station 20. Motor 30 is mounted in the lower section 22 of driving station 20, vented by louvers 38. Base section 22 is wider both to accommodate motor 30, and to provide needed stability. Driving station 20 is supported by lockable base attachment means 24, for example, lockable casters, which fix the station against horizontal movement. The casters may also be used in transporting the apparatus, together with handles 68.

Figure 2:
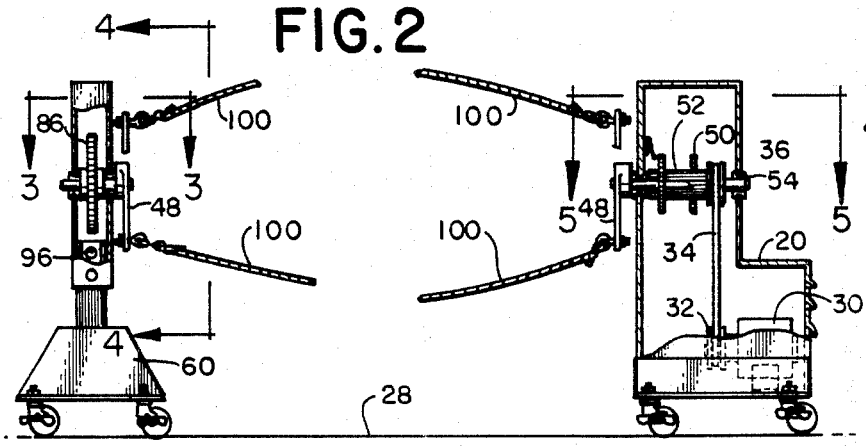
FIG. 2 is a side elevation view of the apparatus, the cabinets again shown partially broken away.

Motor 30 drives the ropes by means of drive belt 34, connecting motor pulley 32 and gear pulley 36. Gear pulley 36 is mounted on one of two central meshing gears 52, rotatably disposed on shafts 42, 44. The central meshing gears 52 in turn drive lever arm gears 50, mounted on shafts 56. Shafts 56 are rigidly attached to lever arms 48, shown in FIG. 2.

Ropes 100 are affixed to lever arms 48 at a point displaced from shaft 56. In order to accommodate jumpers of different sizes, a plurality of points along lever arm 48 may be adapted to receive rope 100.

A rope tensioning apparatus may be included to assist in starting the device, as explained below.

The driving station 20 and its motor 30 may be controlled, for example, by a speed control, timer 110 and/or coin check 114. An additional controller based upon detection of a jam may also be connected, to stop the machine if the jumper misses.

It is also preferred that a revolution counter 116 be included to stop the machine or sound an alarm after a preset number of revolutions, whereby the amount of exercise can be metered. The counter is a valuable source of information as to the quantity of exercise, and may be combined with a frequency meter if desired.

The idler station 60 is not equipped with active driving means. Although a crank 70 may be included for temporary attachment to one of the driven shafts 84, in order to bring the driven side up to speed, the primary source of power for driven side 60 is transmitted from motor 30 in the driving station through ropes 100. The driven side 60 includes lever arms 88, shafts 84 and intermeshing gears 86, forming a mirror image of the gearing on the driving side. In the idler station 60, however, an effort is made to minimize friction, for example only two gears 86 may be employed, rather than four gears as accomplished in the driving side. Of course, in the driving side, additional gears may be required in order to provide a proper gear ratio from motor 30 to the drive shafts 56, 56. An additional weight may be placed in the base of either or both stations to stabilize them against vibration and swaying.

Figure 3:
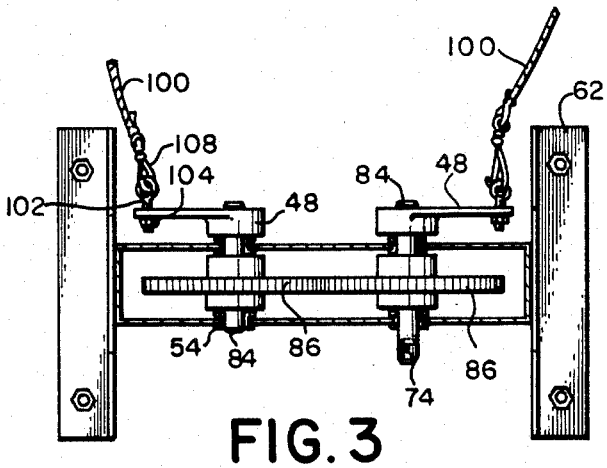
FIG. 3 is a section view of the idler station of the invention, taken along line 3—3 in FIG. 2.

With reference to FIG. 3, rope 100 may be attached to appropriate lever arms 48 by means of eye bolts 102, attached to the lever arms by nuts 104, and spring clips 108. Alternatively, the rope 100 can be passed through eye bolt 102 and knotted, or eye bolt 102 can be omitted, whereby rope 100 can be knotted directly to lever arm 48. In order to more easily start the device, it may also be advisable to increase rope tension temporarily upon starting. A temporary tensioner can be formed by use of a shortenable element in the rope attachment or a jam cleat for attaching the rope at a point spaced from an end. For example, shafts 56 may be hollow and the ropes passed through the shafts to a cleat on the rear of the device for shortening as desired.

Each of the rotating shafts is attached to the casing structure by means of appropriate shaft mounts such as bushings 54. Such bushings, as known in the art, may include ball bearings or the like, as desired. Moreover, in order to minimize friction in the driven side, such low friction mountings are preferred at least there.

As shown in FIG. 3, an additional means of attachment 74 may be affixed to a rear protruding end of one of shafts 84 of the idler side station. Using manual crank 70, shown in FIG. 1, a user can bring the driven station 60 up to speed more quickly. Specifically, crank 70 is attached to shaft 84 by interfitting squared shaft end 74 and crank end receptacle 72. Upon reaching speed, the crank 70 may be pulled axially from shaft 84, allowing gears 86 to turn solely under the influence of driving motor 30 in the opposite station. The crank and/or controllable tensioning of the ropes more quickly synchronize the driving and idler stations.

Figure 4:
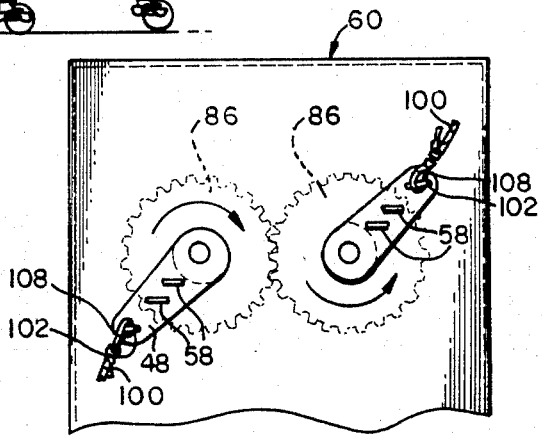
FIG. 4 is an elevation view of the idler station, taken along line 4—4 in FIG. 2, the internal gearing shown in dotted lines.

FIG. 4 illustrates the preferred direction of rotation of gears 86. A manual rope swinger would hold a rope in each arm and alternately cross the ropes over a central location. Alternatively, two swingers could be stationed at either end, one on each end of each rope. In order to simulate manual swingers, the ropes are swung alternately, 180° out of phase, so as to be jumped one after the other in a regular rythm. Since the lever arms 48 are 180° out of phase, they may be longer than the radius of gears 86, such that their circular paths can overlap, in a manner much like the way a user swinging the ropes would overlap the circular arcs. The phase relationship keeps the ropes from interfering, even if the lever arms are long.

It will be appreciated that use of lever arms is preferred but not strictly required. The ropes could be attached at wheels rather than lever arms for example by mounting the gears outside the cabinets. In that case, the gear wheels would include radially spaced holes through which the rope could be passed and knotted. Although such an arrangement could provide additional inertia and would be helpful in balancing the shafts, it is preferred that the gears be covered for reasons of safety.

Figure 5:
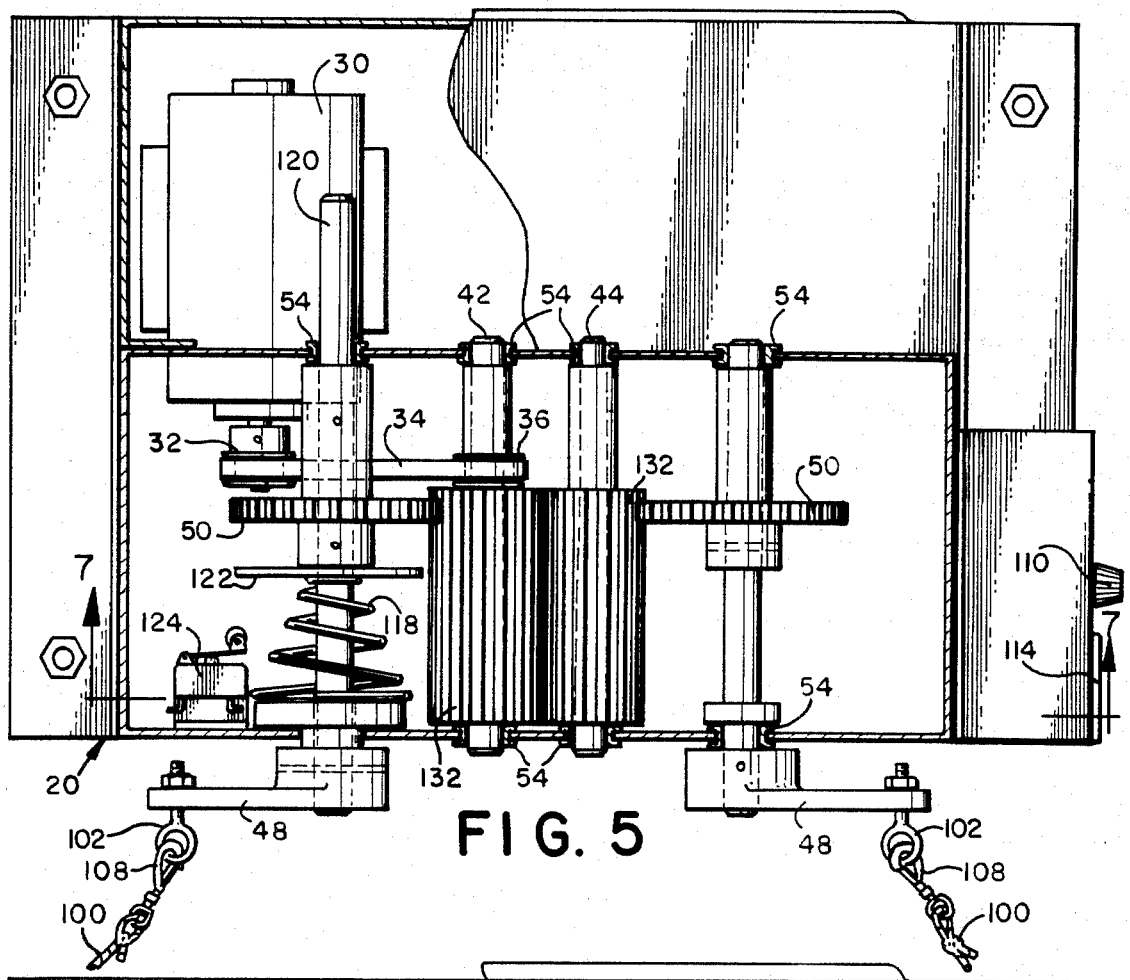
FIG. 5 is a section view of the driving station, taken along line 5—5 in FIG. 2.
Figure 6:
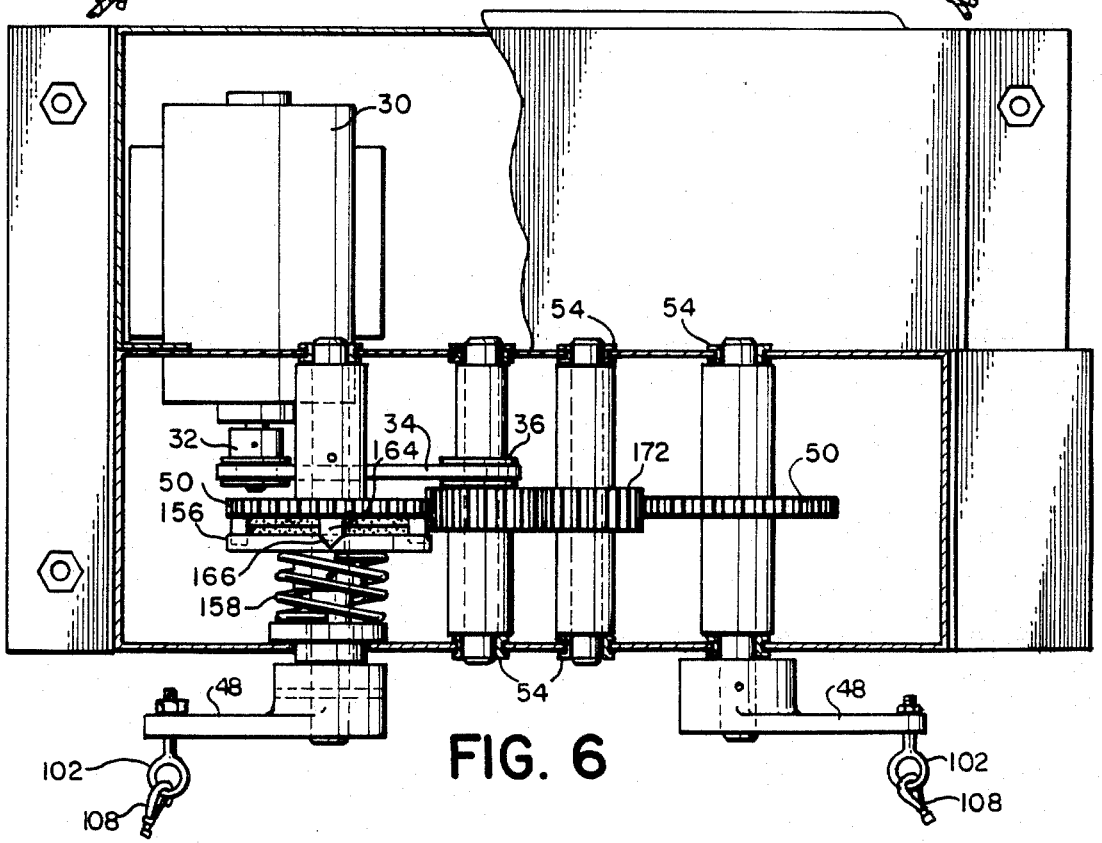
FIG. 6 is a section view of an alternative embodiment of the driving station taken along section 5—5 in FIG. 2.

FIGS. 5 and 6 demonstrate two alternative ways of disconnecting the power should the rope become jammed, for example if fouled by a jumper who misses a jump and is struck by a rope. FIGS. 5 and 6 also illustrate the layout of gears in the driving station 20.

An electrical interlock, shown in FIG. 5, can be provided by inserting limit switch 124 into the electrical circuit powering motor 30. Should the user become fouled in rope 100, an axial force is exerted against slidable shaft 120, causing the same to axially move contact plate 122 against limit switch 124, and against the force of spring 118. The stiffness of spring 118 can be chosen to provide the ease of disconnection needed based, for example, on the weight of rope 100 and the expected size of the jumper. Although limit switch 124 is inherently momentary, the control is preferably arranged such that motor 30 will remain off until restarted, once limit switch 124 has been momentarily activated. As known in the art, this can be accomplished in various ways, such as using a latching relay. The same mechanism can be connected to revolution counter 116 and timer 110 in order to disconnect power and stop the device until restarted once again.

It will be appreciated that the effect of fouling the rope shown in FIG. 5 is to axially displace one of the two lever arm gears 50, in relation to central meshing gears 132. Gear 132 must mesh with the axially movable gear 50 along a substantial axial distance in order to preserve the phase relationship of the lever arms 48. Accordingly, gears 132 are barrel shaped. A similar electric interlock, shown for one rope in FIG. 5, can be provided for both ropes. This is not strictly necessary however, because fouling either rope will be detected within one revolution of shaft 120.

FIG. 6 illustrates a mechanical interlock for accomplishing a similar function. A simple slip clutch would be unacceptable in this application, because upon slipping, the clutch would disturb the phase relationship of lever arms 48. In other words, means must be provided either to hold or to recover the alternating timing of lever arms 48. As shown in FIG. 6, a slip clutch comprising lever arm gear 50 and pressure plate 156, urged toward one another by spring 158, can function to mechanically disconnect motor 30 if the jumper becomes entangled. A force on lever arm 48 tending to axially pull pressure plate 156 away from gear 50 also permits pin 164 to move out of slot 166, thereby allowing relative rotation between gear 50 and lever arm 48. Upon releasing the force on lever arm 48 (i.e., when the jumper is free), gear 50 and plate 156 then move relative to one another until pin 164 again contacts slot 166, locking the two plates against relative rotation at the required angular position. A similar slip clutch is preferably provided on the second driving shaft.

Figure 7:
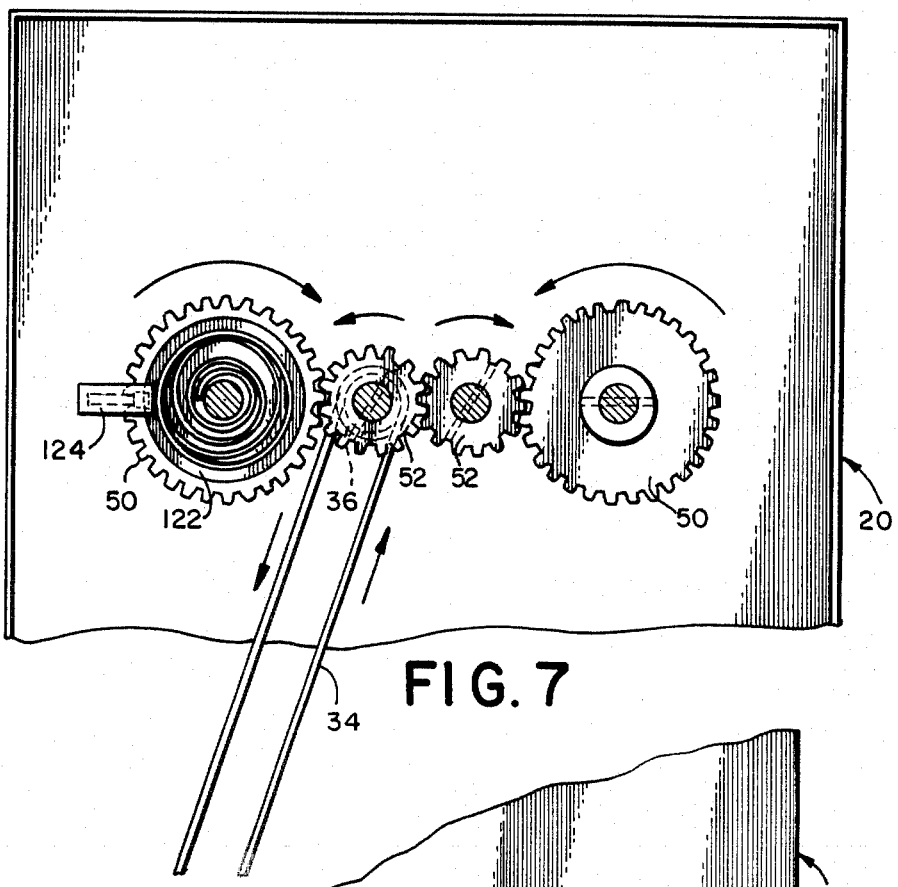
FIG. 7 is a section view showing the driving gears, taken along line 7—7 in FIG. 5.
Figure 8:
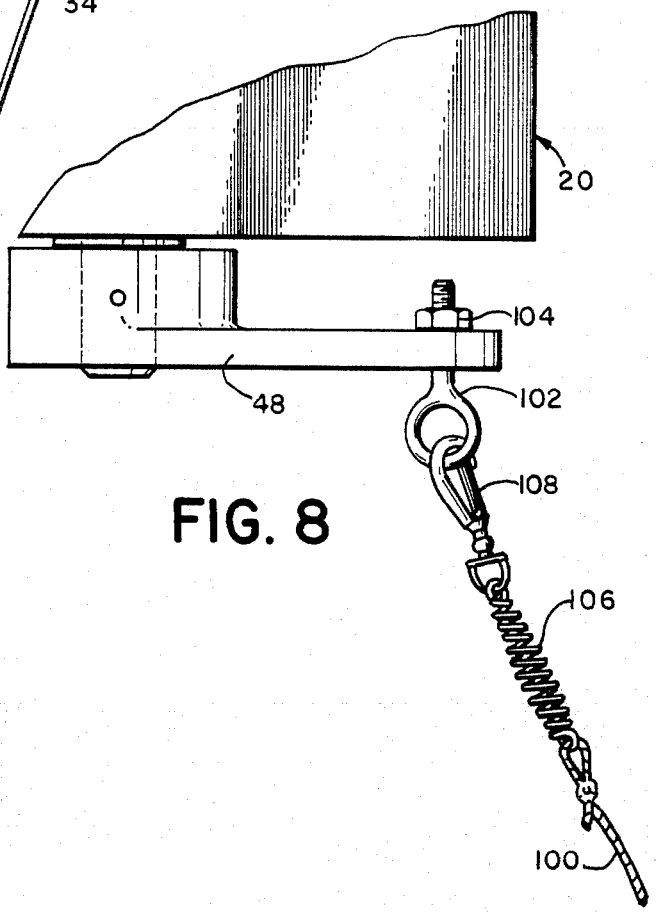
FIG. 8 is a detail top elevation view showing the lever arms and rope connection.

FIG. 7 illustrates the direction of relative rotation between central meshing gears 52 and lever arm gears 50. Under power transmitted by belt 34, gears 50, and therefore the lever arms, rotate in opposite directions. With further reference to FIG. 8, it order reduce vibration and also to avoid striking an unsuccessful jumper with the full force of the rotating machinery, spring 106 is provided between each of the lever arms 48 and the rope 100. Such springs 106 may be provided at each of the four connections between rope 100 and lever arm 48, for example, the connections made by eye bolt 102 and nut 104, and optionally spring clip 108.

The apparatus of the invention may be embodied to be adaptable to users of different ages and sizes. In order to accommodate a range of user heights, the driving and driven stations may be made vertically adjustable, as shown in FIG. 1. FIG. 1 illustrates a driven station 60 having a upper section 66 and a lower section 62, relatively movable with respect to another, and lockable by means of pin 98. Pin 98 locks the sections by means of the plurality of holes 96, at a range of heights. A similar adjustment may be provided by the driving station, however, it will be appreciated that in order to adjustably position the drive height either the motor must be attached to the upper section, or means must be provided to adjustably tension belt 34.

Raising the axis defined by the drive means in order to accommodate a taller jumper is not sufficient of itself. Having raised the rotation axis of shafts 56, 84, and lever arms 48, 88, the driving and driven stations must be moved toward one another, in order to increase the diameter defined by moving ropes 100. If the vertical height is adjusted without adjusting the space between stations, the center of rotation would be higher, however, the taller user would be required to jump higher. Accordingly, in order to facilitate height adjustment, means are provided for positioning the stations at a desired spacing, for example, anchoring pins for passing through the base member, or lockable casters 24 as shown.

The ropes are preferably attachable at a plurality of points 58 along lever arms 48, providing a range of selectable swinging force. Choice of point 58 affects the path of the rope, and also affects the speed and force of the rope by changing the moment arm. The motor speed is preferably made adjustable as well. More proficient jumpers will require the greater challenge of a higher frequency. Virtually continuous control can be provided by a large number of possible discrete speeds. It is preferred that ten discrete speeds be selectable. Inasmuch as proficiency and size or age may be at least partly related (i.e., older children will be larger and better jumpers), the range of permitted speeds can be interlocked with the height adjustment if desired, for example by making electrical contact using pin 98.

The various dimensions, timings and forces required to accomplish this invention may be determined with reference to analagous dimensions and forces in persons who manually swing ropes in the manner contemplated. Lever arms 48, 88 can therefore be determined to be approximately $1\frac{1}{2}'$ long, and are swung at approximately two revolutions per second. With appropriate gearing, motor 30 may be one half horse power or less, turning a rope 100 of $\frac{1}{4}''$ to $\frac{1}{2}''$ diameter, about ten feet long. The motor can be conveniently powered by a battery to provide a more-mobile device. If desired, a series of ropes of various lengths can be provided for users of various heights.

The particular dimensions may be varied within certain limits inherent in any arrangement involving a driving side and an idle side. In particular, use of a very short lever arm or a very long rope will reduce the force exerted on the idler station through the rope (i.e., the coupling between stations). The aforesaid dimensions must be deemed typical only. In order to turn the idler side shafts, a sufficient tangential force must be applied via the rope to bring the idler side up to synchronous speed at an angular lag behind the driving side of less than 180°. Once achieved, the system will maintain operation at the typical dimensions noted. In order to more quickly reach operating conditions, crank 70 is applied to the idle side. In addition (or alternatively), the ropes can be temporarily tensioned to improve the coupling of forces from the driving station to the driven station. Such temporary tensioning can be easily accomplished by moving the stations farther apart until operating conditions are achieved, then moving the stations back together in order to slacken the rope for jumping. In permanent installations, a track or the like can be provided to guide the movable station(s). Starting the drive at a relatively slow speed will also help to achieve coupling more quickly. For convenience, a remote starting switch can be carried on a wire for one person to start the driving means while standing at the idle station ready to operate the crank. Starting can also be automatically delayed to allow the user to man the crank before power is applied to the motor.

The foregoing dimensions and forces can be altered as desired, for example to reflect the dimensions and/or forces of larger, older jumpers. There are further variations which will now be apparent to persons of ordinary skill in the art. Accordingly, reference should be made to the appended claims rather than the foregoing specification as indicating the true scope of the invention.

What we claim is:

1. An exercise device for swinging a pair of flexible jump ropes in phase relation, comprising:

a free-standing driving station having driving means and a pair of spaced shafts rotatable by the driving means, rope attachment means affixed to the shafts and radially protruding from the shafts, the radial protrusions of the rope attachment means being less than the spacing between the shafts, the rope attachment means being rotated by the driving means in substantially a single plane, in opposite directions around said shafts and 180° out of phase;

a free wheeling, free-standing driven station having a pair of driven spaced shafts and rope attachment means corresponding to the driving station, the driven spaced shafts also being geared to remain 180° out of phase and to rotate in opposite directions, the driving and driven stations being connected only by the ropes;

the rope attachment means for one of the shafts including an element movable along the shaft axis, and further comprising a spring biasing said element backwards along the shaft axis and a cutoff means disposed forward of the element, whereby the element is moved against the cutoff to disconnect the driving means upon tensioning of the rope due to striking a user, and whereby operation of the driving station causes corresponding synchronous operation of the freewheeling, driven station, the pair of ropes tracing opposite overlapping arcs for jumping.

2. The exercise device of claim 1, wherein the driving means includes a motor and the rope attachment means includes lever arms attached to the shafts and extending radially therefrom, the lever arms each having means for attaching ends of the ropes to points of attachment thereon, displaced from the shaft.

3. The exercise device of claim 2, further comprising gearing means in the first station operable to maintain a predetermined phase relationship of 180° between the first and second jump ropes.

4. The device of claim 3, further comprising gearing means in the second, freewheeling station for maintaining the phase relationship of 180°, whereby the jump ropes are alternately swung in overlapping arcs for jumping.

5. The device of claim 3, further comprising means attached to the stations for securing them to a mounting surface, said means being releasable, whereby the stations may be moved toward and away from one another to tension the ropes.

6. The device of claim 5, further comprising means for adjusting the vertical position of the driving means.

7. The device of claim 2, further comprising control means including at least one of a coin check for controlling electric power to the device upon receipt of a coin, a timer for limiting running time and said cutoff means including a jam detection switch for releasing power upon misstep by a jumper.

8. The device of claim 1, wherein said cutoff means comprises a mechanical slip clutch having a pair of pressure plates, the plates lockable at a certain angular relationship and slidable at other angles, whereby the phase relationship of the jump ropes may be suspended by action of the slip clutch, and thereafter regained.

9. The device of claim 1, further comprising means to maintain the first and second stations at predetermined range of distances.

10. The device of claim 9, wherein said means for maintaining the stations at said range are locking casters on at least one of the stations.

11. The apparatus of claim 1, wherein said rope attachment means includes lever arms affixed to said shafts, said rope attachment means being located on the lever arms, and further comprising additional rope attachment means at additional radial spacings from said shafts.

12. The device of claim 1, further comprising manual crank means engageable with the freewheeling, driven station, said manual crank means being operable to manually assist in promptly bringing the driven station into synchronism with the driving station.

13. The device of claim 1, wherein the driving means includes a barrel-shaped gear, and the element movable along the shaft axis is fixed to the shaft which is also movable and with a shaft gear meshing with and slidable with respect to the barrel-shaped gear.

* * * * *